US005501523A

United States Patent [19]

Weetman et al.

[11] Patent Number: 5,501,523

[45] Date of Patent: Mar. 26, 1996

[54] IMPELLER SYSTEM FOR MIXING AND ENHANCED-FLOW PUMPING OF LIQUIDS

[75] Inventors: Ronald J. Weetman, Rochester; Richard A. Howk; Thomas A. Post, both of Pittsford, all of N.Y.

[73] Assignee: General Signal Corporation, Stamford, Conn.

[21] Appl. No.: 429,410

[22] Filed: Apr. 26, 1995

Related U.S. Application Data

[63] Continuation-in-part of Ser. No. 369,622, Jan. 6, 1995.

[51] Int. Cl.[6] ..... B01F 7/10

[52] U.S. Cl. ..... 366/263; 366/155.1; 415/211.2

[58] Field of Search ..... 366/262, 263, 366/265, 270, 155.1, 163.1, 164.1, 164.6, 317; 415/211.2

[56] References Cited

U.S. PATENT DOCUMENTS

| | | | |
|---|---|---|---|
| 3,233,876 | 2/1966 | Faure et al. | 366/317 |
| 3,329,407 | 7/1967 | Clough | 366/317 |
| 3,343,815 | 9/1967 | Kingma | 366/317 |
| 3,362,689 | 1/1968 | Rothman | 366/317 |
| 4,628,391 | 12/1986 | Nyman et al. . | |
| 4,721,571 | 1/1988 | Nyman et al. . | |
| 4,747,694 | 5/1988 | Nyman et al. . | |
| 4,786,187 | 11/1988 | Nyman et al. . | |
| 4,979,986 | 12/1990 | Hill | 366/317 |
| 5,185,081 | 2/1993 | Nyman et al. . | |

*Primary Examiner*—Robert W. Jenkins
*Attorney, Agent, or Firm*—M. LuKacher

[57] ABSTRACT

A rotatably driveable enhanced-flow impeller system has a radial flow impeller with a first impeller face disposed proximate the bottom of the tank and proximate or extending into an inlet port for liquids in the tank bottom. The radial flow impeller has a plurality of blades with radially outermost blade tips terminating along a blade terminating circle. The blades and inlet port are contoured to reduce shear stress on the liquids. Disposed adjacent a second opposing face of the radial flow impeller is a radial flow extension plate which preferably extends radially outwardly along the second face by a radial distance beyond the blade terminating circle. The radial flow extension plate may be fixedly attached to the second impeller face. The enhanced-flow impeller system can be used advantageously to form efficiently and with enhanced effectiveness a liquid - liquid dispersion as droplets of at least one liquid in at least one other immiscible liquid and to distribute the dispersion uniformly through the tank volume during a dispersion residence time in the tank, while avoiding, because of minimization of shear stress on the liquids, the formation of fine (smaller) of droplets of one of the liquids that do no readily separate from the other liquid upon settling.

17 Claims, 6 Drawing Sheets

IMPELLER SYSTEM FOR MIXING AND ENHANCED-FLOW PUMPING OF LIQUIDS

This application is a continuation-in-part of U.S. patent application Ser. No. 08/369,622 filed Jan. 6, 1995.

FIELD OF THE INVENTION

The present invention generally relates to mixing and pumping of liquids, and more particularly, the invention relates in one aspect to an impeller system for efficient and enhanced-flow pumping of liquids, and it relates in another aspect to an impeller system and for efficient mixing and enhanced-flow pumping of a dispersion of droplets of at least one liquid in at least one other immiscible liquid in a tank.

BACKGROUND OF THE INVENTION

In typical large-scale industrial mixing and pumping applications, a radial flow impeller, also referred to as a "pumper impeller," is disposed near the bottom of a tank filled with the liquid media to be mixed and to be pumped or just to be pumped through an outlet port of the tank located in an upper portion thereof. Such impellers, frequently open-faced on one face thereof and at least partially open-faced on another face thereof, are rotatably driven by a drive shaft which extends from the impeller to a gear box drive means usually positioned above the tank. Impeller rotation imparts to the liquid or liquids forces which generate in the liquid medium a so-called "head," a measure of the pressure the pumper impeller would generate in the liquid if the tank were completely closed. When the tank has an outlet port, the "head" provides flow of liquid through the outlet, the flow is principally commensurate with the pumping effectiveness of the impeller, the tank configuration and the volume and viscosity of the liquid or liquids to be pumped. The efficiency of pumping may be expressed as the product of the head and flow and a constant divided by the power applied to drive the impeller.

Various industrial mixing and pumping processes are based upon a "flow-through" principle, wherein a liquid or liquids are continuously provided at an inlet port for such liquids, frequently located at or integrated with the tank bottom. The radial flow impeller is usually arranged concentrically with the inlet port and in proximity thereto.

In the aforementioned applications of an open-faced "pumper impeller," the "head" and flow can be increased, at least in principle, by increasing the impeller's rotational speed. Such speed increase requires a higher power input to the drive shaft (and to the gear box drive means), and may result in accelerated wear and/or reduced mechanical integrity of the impeller, the drive shaft and the gear box drive means.

In addition to the aspects of "head" and flow, certain industrial tank-based mixing and pumping processes call for particular outcomes of a mixing and pumping process. For example, so-called solvent extraction processes have a first stage, referred to as mixer tank, in which a dispersion of droplets of one liquid is to be formed in another immiscible liquid by the action of an impeller, and the dispersion is to be pumped through an outlet port to subsequent process stages.

Briefly described, in a solvent extraction process one liquid is an aqueous liquid comprising a solution of metals in dilute sulfuric acid (derived in a prior leaching operation), and another liquid comprises organic fluids (for example kerosene and an extractant). These liquids are provided to the mixer tank through an inlet port (also referred to as an "orifice") located in the bottom of the mixer tank. Generally, a single radial flow inducing impeller (a "pumper impeller") is used near the bottom of the tank to pump the liquids, thereby mixing them and creating a dispersion of droplets of either the organic liquid or liquids in the aqueous liquids or, alternatively, to form a droplet dispersion of the aqueous liquids in the organic liquids, the organic liquid being referred to as the solvent. The selection of the one liquid which will form a droplet dispersion in the other, immiscible liquid, depends on numerous factors, including considerations of the respective liquid volumes, flow rates, choice of aqueous and organic liquids, as well as design considerations pertaining to the mixer tank and the impeller. The mixer tank has a baffled overflow region or weir through which the liquid droplet dispersion enters into a number of successive stirring tanks, eventually to reach a so-called settler stage in which the aqueous phase and the organic phase (the solvent) settle out by coalescence of the dispersed droplets. At respective outputs of the settler stage, the organic and aqueous liquids are drawn off for further processing steps in which the metal to be produced is extracted from the organic or the aqueous liquids (depending on whether the droplet dispersion was formed as solvent droplets in the aqueous continuous phase or as aqueous droplets dispersed in the organic continuous phase), and the solvent liquids are recovered for eventual recycling into the mixer tank. Since a large-scale industrial metallurgical solvent extraction process requires a substantial and continuous quantity of relatively costly organic (solvent) liquids, economic considerations drive the effectiveness of solvent extraction and solvent recovery.

For this reason, a central issue in such flow-through solvent extraction processes is the droplet size distribution of the droplet dispersion formed in the mixer tank under selected input flow rates of liquids for a selected impeller, tank design, and power level applied to the impeller shaft at a certain impeller rotational speed. A second issue is the efficiency of droplet formation while pumping and mixing the dispersion, also referred to as hydraulic efficiency, under certain operating conditions of the mixer tank.

With respect to the size distribution of the droplet dispersion, it is well known that the mass transfer coefficient (a measure of the ability of transferring a mass of one liquid in a dispersed state into another liquid) increases significantly as the droplet size decreases. On the other hand, the coalescence rate of droplets in the dispersion increases rapidly with increasing droplet size, particularly at larger droplet diameters, thus potentially resulting in premature coalescence of droplets into a continuous phase prior to the dispersion reaching the settler stage of the solvent extraction system.

When the droplet size distribution of the dispersion generated in the mixer tank is shifted toward small droplet diameters, such as microdroplets (also called "fines"), a phenomenon referred to as entrainment may adversely affect the downstream refining process of the metal, since, for example, fines of the organic liquids (solvent) may be permanently entrained in the aqueous phase at the settler stage of the process. Such entrainment also reduces the effectiveness of solvent recovery, since permanently entrained solvent droplets effectively constitute a loss of the organic liquids (solvent) in the case of the above example. Therefore, in order to resolve the potentially conflicting requirement of a desirably high mass transfer coefficient at small droplet sizes of the dispersion, having the attendant potential difficulty of entrainment, and the potentially premature coalescence of larger sized droplets, it is desirable to form in the mixer tank a relatively narrow droplet size distribution of the dispersion, an optimum droplet size approximately centered on a droplet diameter at which an acceptable mass transfer coefficient is desirably achieved with minimum potential for entrainment and yet having an acceptable droplet coalescence rate.

Even if operating conditions of a mixer tank do not yield such an ideal relatively narrow droplet size distribution, it is desirable to form a dispersion of non-entraining droplets or, stated differently, it is desirable to form a droplet dispersion devoid of very small droplets (microdroplets) prone to entrainment.

Some of the aforementioned considerations on the performance of a mixer tank of a solvent extraction plant, as well as other aspects thereof, have been described by Warwick and Scuffham in a publication entitled *The design of mixer-settlers for metallurgical duties* in the journal, *Hel Ingenieursblad,* 41*e jaargang* (1972), nr. 15.16, pages 442–449, and by Lott, Warwick, and Scuffham in a paper entitled *The design of large scale mixer settlers,* presented at the AIME Centennial Annual Meeting in 1971.

These authors describe the design of mixer-settlers of a solvent extraction process using a single pump-mix impeller with curved blades in the mixer tank to generate the dispersion of droplets from the organic and aqueous liquids, the mixer tank being followed immediately by a settler stage. Since the early 1970's, solvent extraction plants have evolved which include in their design one or several stirrer tanks disposed between the mixer tank and the settler stage.

As indicated in the foregoing, in a tank-based pumping system it is desirable to pump a liquid or liquids efficiently and with an enhanced flow through an outlet port of the tank by an impeller in the tank. Such enhanced pumping at a given power applied to the impeller, and alternatively efficient but non-enhanced pumping at a reduced impeller power input level, is desirable in applications using a liquid-filled tank with a closed tank bottom and in so-called flow-through systems.

In tank-based, flow-through pumping and/or mixing systems, it is desirable to pump and/or mix liquids with an enhanced liquid flow. In a particular, pumping and mixing process designed for effective operation of a mixer tank of a metallurgical solvent extraction facility, it is desirable to achieve enhanced-flow pumping and mixing of at least two immiscible liquids so as to form a dispersion of droplets of at least one liquid in at least one other liquid, wherein droplet sizes are desirably produced which result in non-entraining conditions in subsequent process stages of such a facility.

SUMMARY OF THE INVENTION

It is the principal object of the present invention to provide an improved efficient and enhanced-flow impeller system for pumping liquids in a tank through an outlet port thereof.

Another object of the invention is to provide an improved impeller system for mixing liquids and liquid dispersions in a tank.

A further object of the present invention to provide an improved impeller system for forming a dispersion of non-entraining droplets among at least two immiscible liquids in a single mixer tank which is especially suitable for use in a metallurgical solvent extraction process.

Another object of the invention is to provide an improved impeller system for forming a droplet dispersion having a uniform spatial distribution of droplets throughout a mixer tank.

A further object of the present invention is to provide in a single tank an efficient, improved impeller system which can pump and mix liquids in a tank using desired impeller driving power.

Briefly described, the present invention provides, in one embodiment thereof, an enhanced-flow impeller system for pumping and/or mixing liquids in a single tank. One component of the impeller system of the invention is a radial flow impeller having on a first face thereof a plurality of radial flow inducing impeller blades disposed proximate the bottom of the tank in which the liquids are contained. Alternatively, the first impeller face is proximate a liquids inlet port at the tank bottom and coaxial therewith. In a currently preferred embodiment, the impeller blades are tapered towards their tips and have contoured edges. The input port may be contoured. The blades and port are effective in reducing shear stress, which reduces fines when a dispersion of immersible liquids is mixed or pumped, and is also effective in increasing the efficiency of the system. The radial flow impeller is attached to a drive shaft which can be rotatably driven by gear drive means.

The impeller system of the invention may have a radial flow extension plate disposed adjacent a second opposing face of the radial flow impeller and extending radially outwardly therealong by a radial distance which is greater than the diameter of a circle described by the terminations of the tips of the impeller blades. The extension plate may be stationarily disposed adjacent the second impeller face by mounting the plate to the bottom or side walls of the tank. Alternatively, the extension plate may be fixedly attached to the second impeller face, whereby the plate and the impeller together are rotatably driven by the drive shaft.

BRIEF DESCRIPTION OF THE DRAWINGS

The aforementioned and other objects, features and advantages of the present invention will be better understood and appreciated more fully from the following detailed description, taken in conjunction with the accompanying drawings, in which:

FIGS. 6 A, B & C are respectively end (from the tip) and sectional views of a typical blade of the impeller shown in FIG. 6.

DETAILED DESCRIPTION OF THE EMBODIMENTS

Figure 1:
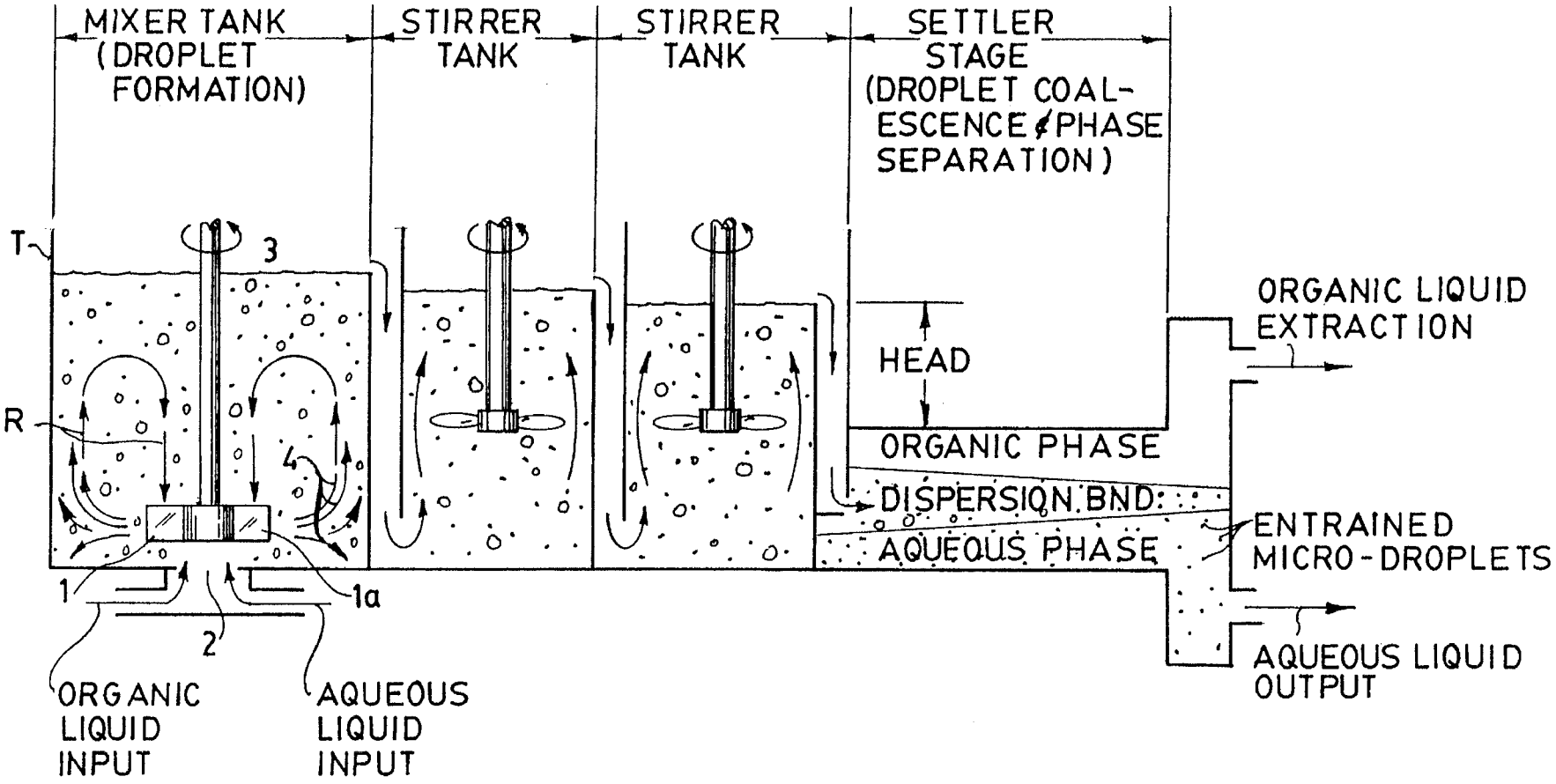
FIG. 1 PRIOR ART
FIG. 1 depicts a portion of a prior art metallurgical solvent extraction facility in which a single open-faced radial flow impeller is used in a mixer tank to form a droplet dispersion therein, followed by two stirrer tanks having axial flow impellers, and terminating in a settler stage from which the organic liquid (solvent) is removed for further processing and eventual recycling through the process, and from which an aqueous phase (for example, containing the metal of interest) is directed to further process stages.

Referring now to FIG. 1, there is shown a portion of a prior art metallurgical solvent extraction facility, including a mixer tank followed by two successive stirrer tanks and a settler stage. The mixer tank T has a conventional straight-bladed open radial flow impeller 1 disposed near the tank bottom proximate a liquids inlet port 2, the inlet port being provided organic liquids, for example an extractant in kerosene, and an aqueous liquid in the form of a solution, for example copper sulfate delivered in a certain concentration of sulfuric acid solution. The impeller 1 is rotatably driven by a drive shaft 3 to generate a droplet dispersion of either organic liquid droplets in a so-called continuous aqueous phase or, alternatively, to generate a dispersion of aqueous droplets in a continuous organic phase. Arrows generally designated at 4 indicate a somewhat divergent radial liquid flow generated by the radial flow impeller 1, and recirculation flow patterns in the tank T are designated at R. The impeller 1 provides the droplet dispersion by the pumping action imparted by the impeller blades la on the liquids in the tank.

An overflow of the droplet dispersion created in the mixer tank T is indicated by arrows to proceed through a baffled passageway to a first stirrer tank in which the dispersion is stirred by an axial flow impeller and from which the dispersion overflows through another baffled passageway to a second stirrer tank also having an axial flow impeller. From this latter stirrer tank the overflow is directed through a baffled passageway into a so-called settler stage wherein phase separation of the droplet dispersion is to be effected by droplet coalescence, thereby ideally providing an organic phase (i.e., the organic liquids originally provided at the inlet port of the mixer tank) and an aqueous phase. The organic liquids and aqueous liquids are directed to further process stages (not shown) for extracting the metals and for recovering the organic liquids (solvents) for eventual recycling to the mixer tank.

For illustrative purposes only, the mixer tank T of FIG. 1 is shown to produce a relatively wide droplet size distribution including numerous very small droplets (also referred to as fines or microdroplets) indicated as dots in the dispersion. Such relatively wide droplet size distribution is common in mixer tanks which use open-faced straight-bladed radial flow impellers exerting a high shear force on the liquids. Such small droplets may remain permanently entrained in the settler stage, either as very small solvent droplets in the aqueous phase, as depicted in FIG. 1 or, alternatively, as very small aqueous droplets dispersed in the organic phase. In either event, such permanent entrainment of small droplets of one liquid in the other liquid causes difficulty in subsequent process steps such as the organic liquid recovery or the metal refining process steps.

Figure 2:
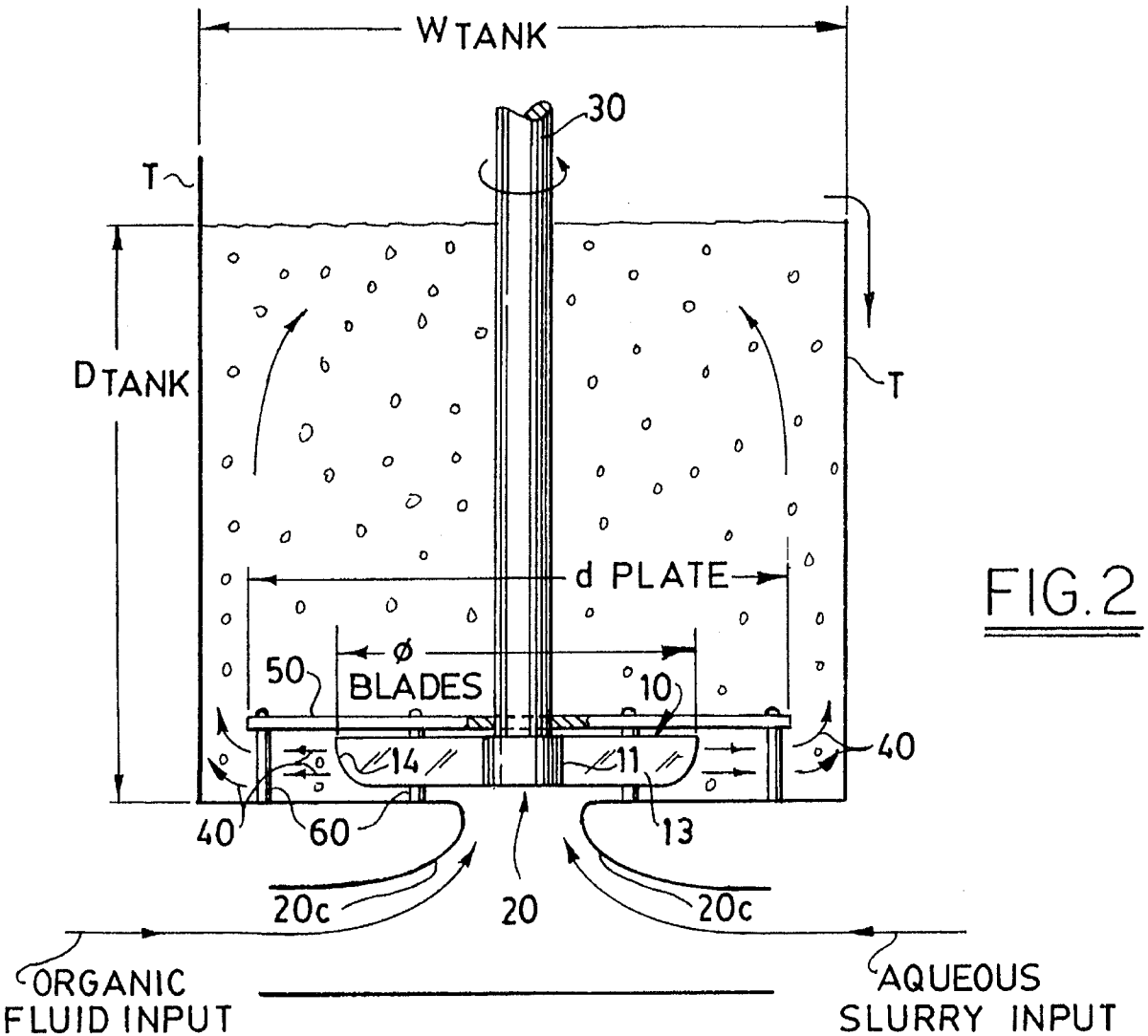
FIG. 2 is a schematic side view of an efficient, enhanced-flow pumping and mixing system with an impeller having contoured blades and having a contoured inlet port in accordance with a first embodiment of the present invention.

Referring now to FIG. 2, there is shown a schematic side view of a pumping mixer tank T and mixing system in accordance with the present invention. An aqueous slurry input and an organic fluid (solvent) input are indicated by arrows to be directed along smoothly contoured fluid inlet walls 20C to a fluid inlet port 20 of the mixer tank T. A radial flow impeller generally designated at 10 has a plurality of impeller blades 13 attached to a hub 11, each blade having a smoothly contoured radial tip 14. A radial flow extension plate designated at 50 is disposed closely adjacent to and parallel with an upper face of the radial flow impeller 10, the plate 50 having a radial dimension $d_{PLATE}$ radially extending outwardly beyond a circle describing the blade tip terminations of impeller 10 by a diameter $Ø_{BLADES}$. The plate 50 is shown as being supported by studs or rods 60 on the bottom of the mixer tank. Arrows 40 indicate a substantially extended radial flow path of the fluids and the dispersion of droplets therein as compared to the radial flow pattern 4 of FIG. 1. The radial flow impeller 10, is rotatably driven by the drive shaft 30.

The tank T, may have cylindrical side walls or walls shaped in the form-of a regular polygon, for example a square or a hexagon, has the inlet port 20 extending over a portion of the tank bottom for providing an input of the liquid or liquids to be pumped by the impeller system in the tank. The tank T is shown to have a width dimension $W_{TANK}$, and a tank depth $D_{TANK}$ from the tank bottom to the weir or outlet. The contoured walls 20C to the inlet port 20 for the liquid(s) define a cylindrical neck portion N extending to the tank bottom.

In the radial flow impeller 10, also referred to as a pumper impeller, the plurality of radial flow inducing impeller blades 13 are of a blade height $H_{BLADE}$. See also FIGS. 4A and B. A lower or first face of the impeller 10 defined by the edges of the blades 13 extends downwardly and is spaced closely adjacent to the bottom of the tank.

The radial flow impeller 10 of FIG. 2 is depicted with a hub 11 to which a rotatably driven drive shaft 30 is attached. Numerous other approaches are known for mounting a metallic drive shaft to a metallic impeller, including welding, brazing, and by the use of bolts, threads, and the like. When the impeller and the drive shaft are of fibrous and plastic materials, known bonding methods may be used, for example thermal or adhesive bonding. Thus, the hub 11 is shown for illustrative purposes only.

Figure 4A:
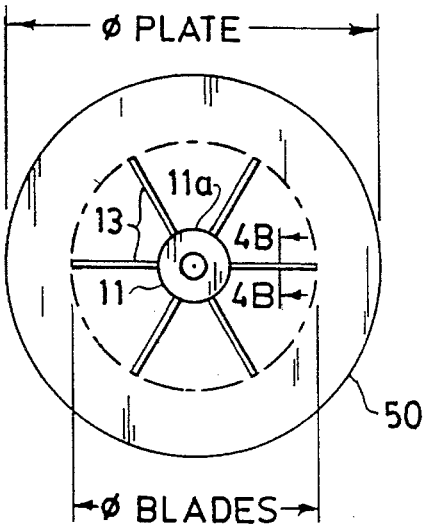
FIG. 4A is a plan view of a straight-bladed radial flow impeller as viewed from the bottom of the tank of FIG. 2, and a radial flow extension plate of circular shape radially extending outwardly beyond a blade termination circle.
Figure 9:
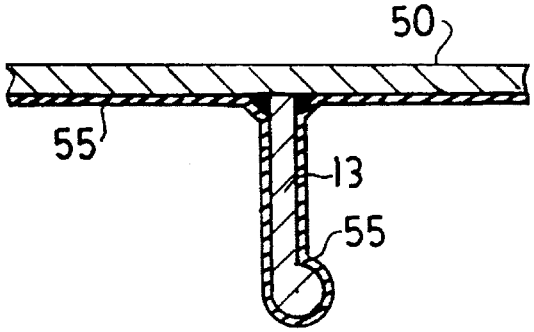
FIG. 9 is a sectional view similar to FIG. 6A showing a blade and plate of the impeller which are covered by a layer of elastomeric material to reduce the formation of fines.

The radial flow inducing blades 13 of the impeller 10 are shown (See FIG. 4A and B) to have radially outermost blade tips which terminate at a blade terminating circle of a diameter $Ø_{BLADES}$ which is larger than the diameter of the cylindrical neck portion N of the inlet port 20. The blades may be attached to and rotatable with an extension plate 52 as shown in FIGS. 4 and B. The blades may be curved (back swept) and taper upwardly to the extension plate 54, as shown in FIG. 5. The blades may also taper toward the tips and have bulbous edges as shown in FIGS. 6 and 6A–C. The contoured neck of the inlet and blades reduce shear stresses and thereby minimize fine formation in operation of the system. Still further reduction of fines may be obtained by suppressing breakup of larger droplets upon collisions thereof with the blades 13. As shown in FIG. 9, the blade surfaces are covered by a layer 55 of elastomeric material. The bottom and edges of the extension plate may also be covered by the layer. The material of the layer is preferably HMW (high molecular weight) polyethylene or rubber. Polishing of the surfaces of the blades also reduces fine formation by collusions, but is more expensive and less effective than the elastomeric material layer.

The radial flow extension plate 50 (FIG. 2) is disposed adjacent an upper or second face of the radial flow impeller 10. The plate 50 extends radially outwardly parallel to the upper impeller face by a radial distance beyond the blade terminating circle $Ø_{BLADES}$, and has a radial extent $d_{PLATE}$. The radial flow extension plate 50 is stationarily disposed adjacent to the upper impeller face and is shown mounted to the tank bottom by studs or rods 60. The plate 50 can also be mounted to the side walls of the tank T by radial brackets and the like (not shown).

Figure 8:
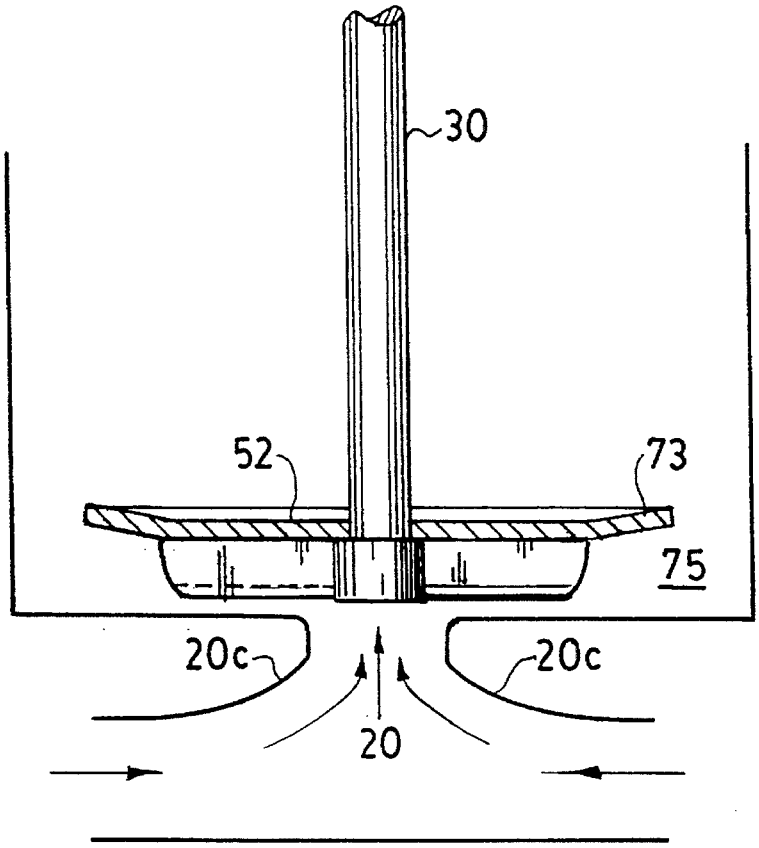
FIG. 8 is a schematic side view of a portion of an efficient enhanced flow system similar to the system of FIG. 2 with a radial flow extension plate to which the impeller is rotatably attached and which diverges away from the bottom of the tank.

In order to further control shear stress on the liquid being dispersed and thereby reduce fines, an extension plate 52 has an outer rim 73 (FIG. 8) which diverges at an acute angle to its lower surface to define an annual diffusion region 75, as shown in FIG. 8, there the plate 52 is attached to and rotates within the impeller 10.

The peripheral outline of the radial flow extension plate 50 is preferably circular when installed in a tank T having cylindrical side walls, and the outline may be that of a regular polygon, for example a square or a hexagon, when installed in a tank of respectively similar polygon-shaped side walls, but a circular plate 50 may be used in a polygonal tank or vice versa, i.e., the periphery of the plate need not match the shape of the walls of the tank.

The radial flow extension plate 50 radially extends the radial flow component of the liquid(s) being pumped, as indicated by flow lines 40, compared to the more divergent radial flow produced by the open-faced impeller 1 with flow lines 4 (see FIG. 1).

During laboratory investigations of radial flow patterns induced by a variety of straight-bladed and curved-bladed radial flow impellers, significant recirculation flow (such as indicated at R in FIG. 1) was observed in a laboratory tank. Since significant recirculation of a droplet dispersion is thought to be adversely affecting the efficiency of forming the dispersion, various efforts were made to disrupt or minimize such recirculation flow. Quite surprisingly, it was found that a plate positioned stationarily adjacent an upper or second impeller face and extending radially outwardly beyond the impeller blade tips had a marked and unexpected influence on both the effectiveness of pumping liquids and the size distribution of droplets generated by the impeller 10 by any of the radial-flow impellers studied when used in conjunction with a stationary plate 50. Similarly unexpected observations were made when a circular radial flow extension disk was fixedly attached to the upper or second impeller face so that the disk and the impeller were rotatably driven together. The contouring of the inlet port 20 and the blades also contributes to the enhanced flow and efficiency of pumping and mixing. Thus at a normal feed rate of liquids through an input port 20, a dispersion is produceable by the impeller/plate combination at substantially reduced drive speed imparted to the drive shaft 30. Also, the droplet size distribution generated by this combination is substantially free of very small and potentially entrainable microdroplets (fines).

Non-rotating plates 50 of various dimensions and shapes were subsequently investigated to verify and optimize the originally observed effects on liquid flow and droplet size distribution. With respect to the plate dimension $d_{PLATE}$ it was found that the aforementioned unexpected and desirable features could be partially achieved when the ratio $d_{PLATE}$/ blade terminating circle was greater than about 1.1. At a ratio greater than about 1.33 (an 8-inch to 10-inch diameter plate over a 6-inch diameter impeller) the desirable effects were fully evident. With respect to shapes of plate 50, it was observed that circular disks, as well as regular polygonal shapes, including a square-shaped plate, performed equally well in conjunction with a selected radial flow impeller. It was noticed, for example, that a stationary square-shaped plate 50 positioned adjacently above an impeller 10 could be advantageously used in a square-shaped mixer tank T, whereas a stationary circular plate could be readily retrofitted above an impeller 10 immersed in a cylindrical mixer tank.

Thus, an immediate practical advantage of using a stationary radial flow extension plate 50 is to retrofit existing mixer tank installations used for pumping of liquids or for forming dispersions with a suitably dimensioned and shaped plate so that such operating systems can benefit from the enhanced-flow pumping or, alternatively from a reduced power requirement to the impeller drive shaft and, in dispersion-forming applications, provide a dispersion substantially free of entrainable droplets. Such retrofitting in the field can be accomplished by disconnecting the drive shaft 30 from its gear drive and motor assembly (not shown) and to slide plate 50 through a central bore therein over the drive shaft, and suitably fastening the plate either to the tank bottom via studs or legs 60 or, alternatively, to fasten the plate on the walls of the mixer tank T by suitably arranged brackets and the like. As indicated previously, such retrofitting of a radial flow impeller 10 with a radial flow extension plate 50 has to be performed in consideration of features of the mixer tank T such as the width of the tank $W_{TANK}$, the shape of the mixer tank and other aspects of a pre-existing mixer tank which may influence the selection of the fastening method of the plate to the tank.

Figure 3:
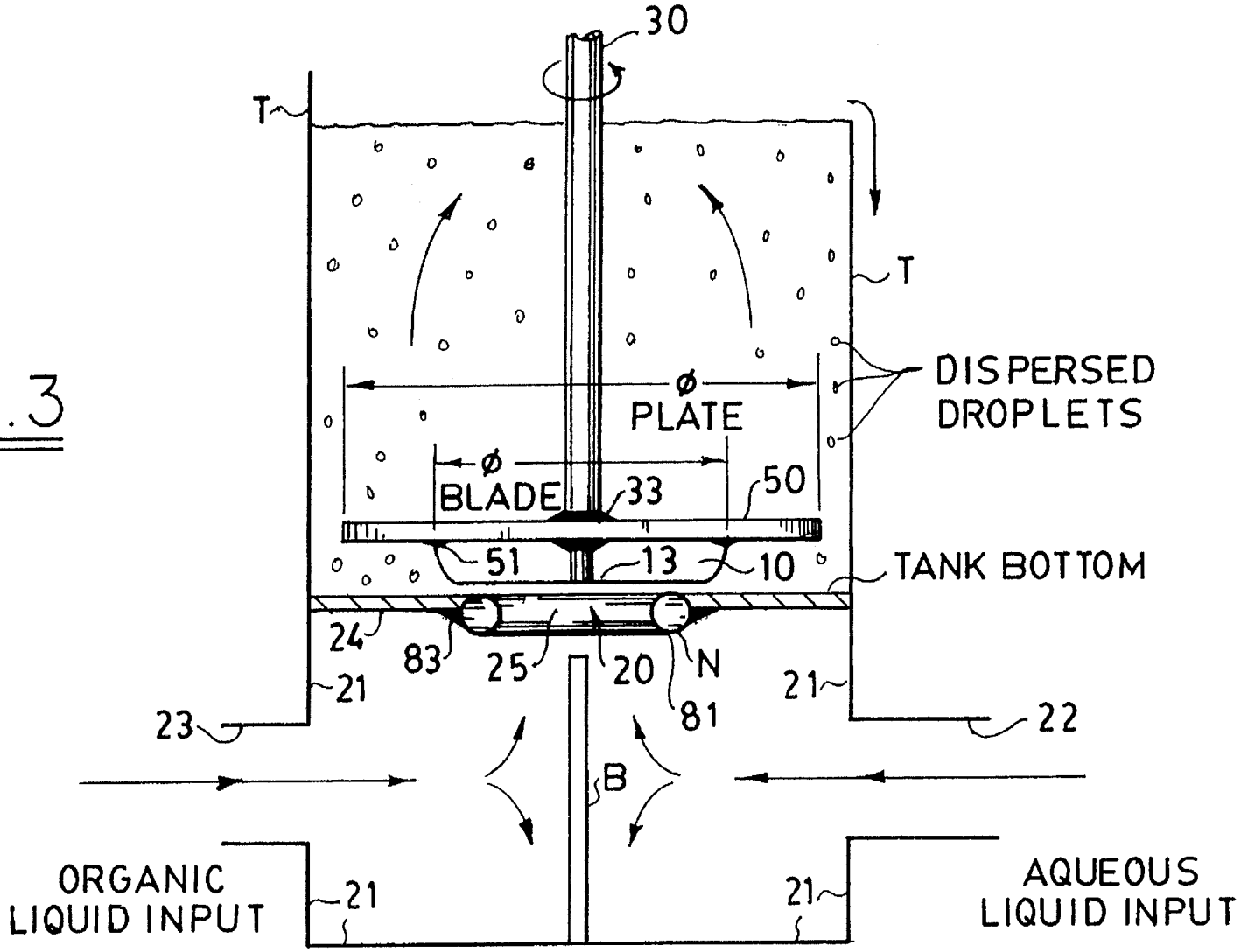
FIG. 3 is a schematic side view of an efficient, enhanced-flow pumping and mixing system in accordance with a second embodiment of the invention having a radial flow impeller with contoured blades and having a radial flow extension plate attached thereto, and with another type of contoured inlet port.

Referring now to FIG. 3, there is shown a schematic side view of an enhanced-flow impeller system in accordance with another embodiment of the invention. Here, a lower or first face of the radial flow impeller 10 is disposed proximate the bottom of a cylindrical tank T and concentric with respect to a cylindrical neck portion N of an inlet port 20 for the liquid or liquids to be pumped. The neck portion is contoured by means of a ring 81 having a circular cross section which is tangent to a conical annulus 83.

A circular disk radial flow extension plate 50 of a diameter $Ø_{PLATES}$ extends radially beyond the radially outermost tips of the plurality of impeller blades 13, and is fixedly attached by welds or adhesive bonds 51 to the upper or second face of the impeller 10.

A drive shaft 30 is depicted as being bonded to an upper surface of the plate 50 by a weld or adhesive bond 33, the bond type dependent upon the selection of materials used for the drive shaft, the plate, and the impeller (metals; plastics).

A dispersion of droplets is formed in the mixer tank T among at least two immiscible liquids.

An aqueous liquid input and an organic liquid input are indicated by arrows to be directed via respective input pipes 22 and 23 into a plenum-like chamber 21, and the liquids flow from the chamber through an axially concentric aperture 25 in a disk-shaped plate 24 onto the lower face of blades 13 of a radial flow impeller 10. The liquid inputs are partially isolated from one another by a baffle B extending upwardly from a lower surface of the chamber toward the aperture 25.

A radial flow extension plate 50 is fixedly attached to an upper or second face of the impeller 10 in a manner as previously described with reference to FIG. 3. An impeller shaft 30 is schematically shown attached to an upper surface of the plate 50.

Thus, when designing the enhanced-flow impeller system of the invention for a particular pumping and mixing application in a mixer tank, the radial flow impeller in conjunction with the radial flow extension plate are designed such that the impeller system is operative to provide an optimized pumping efficiency and effectiveness for a particular droplet dispersion to be created and pumped in a particular tank. Stated differently, the impeller system is configured to provide comparable pumping efficiency and effectiveness and for the radial flow impeller with its extension plate. In this configuration, the radial flow extension plate 50 can be effective if it extends radially outwardly to at least the blade terminating circle described by the tips of the blades 13.

It is anticipated that new installations of the impeller system in accordance with the invention will be constructed of metals or, alternatively of molded fibrous and plastic materials. Such fibrous and plastic materials may also be advantageously used to construct the mixer tank T. An axial flow impeller and impeller shaft constructed of a composite of fibrous and plastic material has been disclosed in U.S. Pat. No. 4,722,608, issued Feb. 2, 1988. The design considerations incorporated in that disclosure can be used to design and fabricate an integrated impeller system of a fibrous and plastic material composite which includes the drive shaft 30, a suitably positioned axial flow impeller 70, and a radial flow impeller 10. Furthermore, complete new impeller systems in accordance with the invention can incorporate the radial flow extension plate 50 also fabricated from a composite of fibrous and plastic materials and integrally bonded to the upper face of the radial flow impeller 10 so that such extension plate 50 becomes an integral and rotating part of the impeller system.

The effectiveness of the impeller system of FIG. 3 in providing a spatially uniform distribution of dispersed droplets created by the radial flow impeller 10 at a significantly enhanced liquid flow rate (when used in conjunction with the radial flow extension plate 50) and alternatively at a reduced power level applied to the drive shaft 30, permits the construction of a mixer tank T of reduced volume under otherwise comparable conditions of forming a liquid-liquid dispersion.

Referring now to FIG. 4A, there is shown a schematic plan view of a straight-bladed radial flow impeller 12 having blades 15 emanating from a hub 11, and having radially outermost blade tips terminating on a blade termination circle having a diameter $Ø_{BLADES}$. A circular radial flow extension plate 52 has a diameter $Ø_{PLATE}$ whereby the ratio of the plate diameter to the diameter of the blade termination circle has at least a value of 1.1. The plan view of FIG. 4A appears as viewed from the bottom of the tank T in FIGS. 2 and 3. The radial flow extension plate 52 can be fixedly attached to an upper face of the radial flow impeller 12, and alternatively, it can be disposed in a non-rotating manner adjacently above (see FIG. 2) that face of the impeller by suitable mounting means 60. It should be noted that the hub 11 is not required in impeller designs having the impeller blades 15 attached to the plate 52 or to another blade supporting means. In the absence of a hub, the blades emanate from a circle of a diameter (11*a*) which may be greater or less than the hub diameter indicated in FIG. 4A.

Figure 4B:
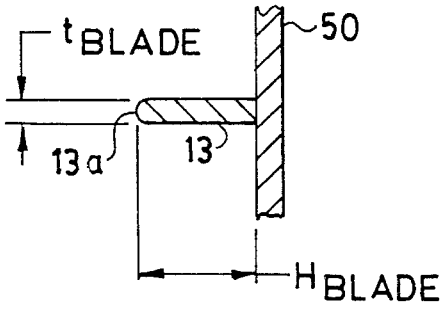
FIG. 4B is a sectional view of one impeller blade of the impeller of FIG. 4A, showing an arcuate surface on one blade face.
Figure 5:
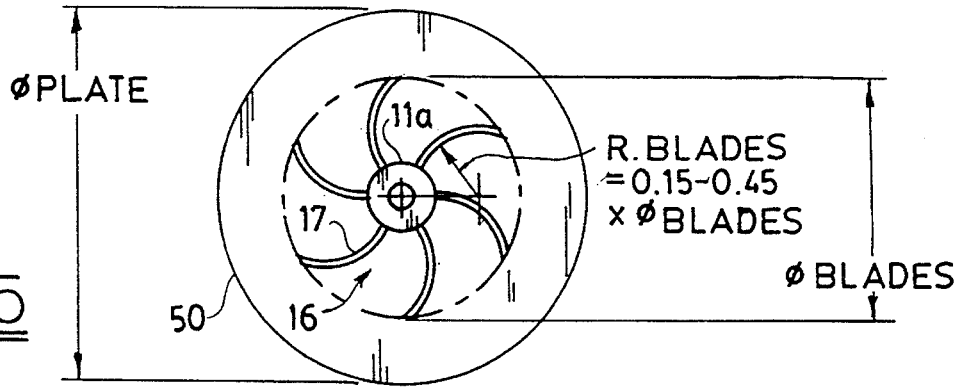
FIG. 5 is a plan view of a radial flow impeller with curved blades which are contoured toward their tips.

Referring now to FIG. 4B, there is shown a schematic sectional view of an impeller blade 15 and a portion of the plate 52, taken along the lines 4B—4B in FIG. 4A. The blade 15 has a blade height $H_{BLADE}$ and a blade thickness $t_{BLADE}$. An arcuate lower blade surface 15*a* may be a radius equivalent to one half of the blade thickness. Such arcuate lower blade surface may be particularly desirable when the impeller 12 is constructed of fibrous and plastic composite materials.

Figure 6:
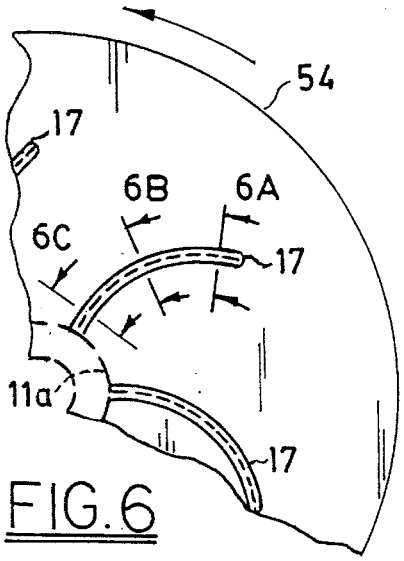
FIG. 6 is a perspective view of a radial flow impeller having contoured curved blades, as seen from the liquid inlet port of FIG. 3, and having a circular radial flow extension plate which radially extends outwardly beyond a blade termination circle.
Figure 6A:
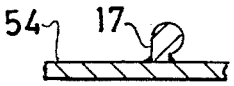
Figure 6B:
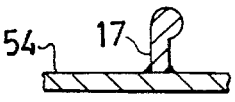
Figure 6C:
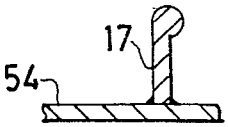

Referring now to FIG. 6, there is shown a currently preferred embodiment of a radial flow impeller 16 having curved (back-swept) impeller blades 17 which are attached (for example by welding as depicted in FIGS. 3 and 4) to a radial flow extension plate 54 in such a manner that the radially innermost blade ends emanate from an axially concentric circle of a diameter 11*a* shown in dashed outline, and wherein the radius of curvature $R_{BLADE}$ of each blade is in the range of from 0.15–0.45 of the diameter $Ø_{BLADE}$ the blade termination circle as described by the tips of the curved blades. The blades 17 have bulbous edges and are tapered in height ($H_{BLADE}$) decreasingly toward the tops thereof as shown in FIGS. 6A–C. A circularly shaped, disk-like, radial flow extension plate 54 can be disposed adjacently above one face of the impeller 16 and supported at the tank bottom or the tank sidewall by means previously described, and, alternatively, the plate 54 can be fixedly attached to that face of the radial flow impeller 16. Again, the previously described and unexpected advantages of the radial flow extension plate 54 are evidenced when the plate diameter is at least 1.1 times the diameter of the blade termination circle.

While the advantages of the impeller system, in accordance with the invention, are observed for each one of a number of radial flow impellers (used in conjunction with a radial flow extension plate) differing in the degree of curvature of the impeller blades (from the straight blades of FIG. 4 and to the curved blades of FIGS. 5 and 6), currently best results are obtained with an impeller system of the invention in which the dispersion-creating radial flow impeller has curved impeller blades.

Another aspect of impeller blades of the radial flow impeller (also referred to as the pumper impeller) which can be optimized for new installations of an impeller system in accordance with the present invention is the ratio of the height or depth of the blades to the diameter of the blade terminating circle described by the blade tips upon impeller rotation. Depending on the particular requirements of liquid pressure ("head") and liquid flow to be achieved by a selected impeller system in a selected pumper or mixer tank, an optimum ratio in the range of from about 0.125 to about 0.3 of the blade height or depth to the blade terminating circle diameter is desirable.

Figure 7A:
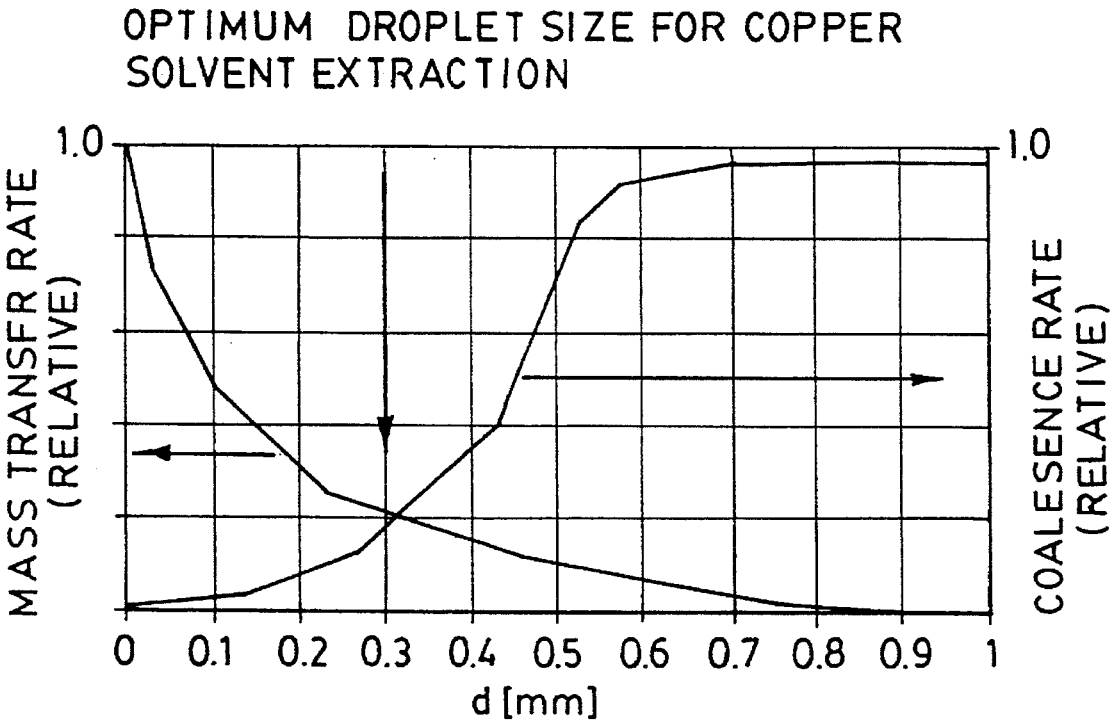
FIG. 7A shows plots schematically representing a relationship between a relative mass transfer rate and a droplet coalescence rate as a function of droplet diameter in a dispersion of two immiscible liquids, wherein an optimum droplet size is indicated at the crossover between the mass transfer function and the droplet coalescence function.

Referring now to FIG. 7A, there are shown idealized plots schematically representing a relationship between a relative mass transfer rate and a coalescence rate of a dispersion of droplets of one liquid in another immiscible liquid with respect to a droplet diameter. From these plots, which shows operation in a solvent extraction process, an optimum droplet size of approximately 0.3 mm droplet diameter can be readily identified as being located at the crossover of the two functional relationships. Of course, another value of an optimum droplet size would be found for different operating conditions (such as, for example, the liquid flow through the mixer tank, the viscosity of the liquids, the design details of the droplet dispersion-creating radial flow impeller, and the like). However, even under such differing conditions, the crossover between the mass transfer rate trace and the coalescence rate trace would provide an optimum droplet size for a dispersion created in a mixer tank.

Figure 7B:
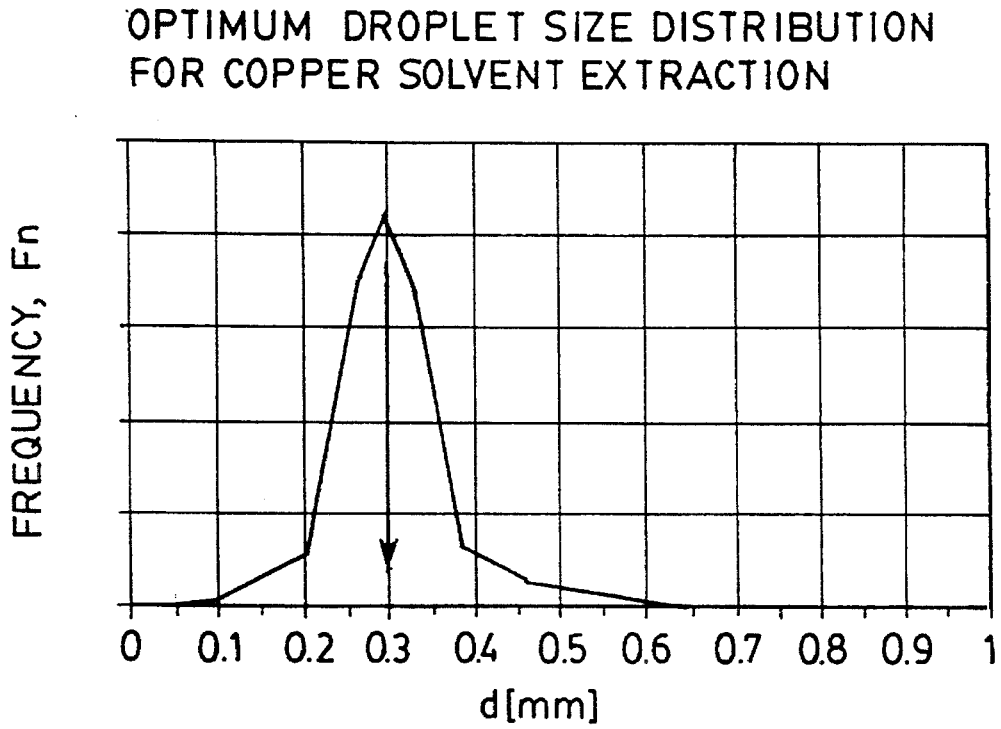
FIG. 7B indicates schematically a trace representing an optimum droplet size distribution for the optimum droplet size.

Referring now to FIG. 7B, there is shown a schematic representation of an optimum droplet size distribution. Not unexpectedly, it is seen that the idealized optimum droplet size distribution is relatively narrow and centered about a droplet diameter of 0.3 mm, with about 80 percent of the droplets distributed over a droplet diameter range from about 0.2 to 0.4 mm.

As indicated previously, with respect to FIG. 7A, the optimum droplet size distribution would be different or shifted to larger or smaller optimum droplet size when changes are made to the operating characteristics of a mixer tank.

From the foregoing description of the embodiments, it will be apparent that an enhanced-flow impeller system has been provided for enhanced-flow pumping and mixing applications of liquids, including the forming of a dispersion of droplets of at least one liquid in at least one other immiscible liquid in a single mixer tank suitable for use in a metallurgical solvent extraction process. With the impeller system, a radial flow impeller having radial flow inducing blades creates the dispersion of droplets in a lower portion of a mixer tank. A radial flow extension plate fixedly attached to an upper face of the radial flow impeller, and, alternatively, disposed adjacently thereto, extends radially outwardly at least to the radially outermost terminations of the blades, whereby a radially extended zone of enhanced radial liquid flow is achieved and a droplet dispersion is created with enhanced effectiveness. Additionally, numerous means for mounting a stationary radial flow extension plate adjacently above one face of the radial flow impeller or to fixedly attach such a plate to an impeller face will undoubtedly suggest themselves to those skilled in this art. The efficient operation of this impeller apparatus (with or without a top plate) in creating a narrow droplet dispersion with a small percentage of microdroplets can also be used in a mixing system that does not require the impeller to pump as well as mix and disperse. These and other modifications are within the spirit and scope of the invention, as defined in the specification and the claims.

What is claimed is:

1. An enhanced-flow and efficient impeller system for forming a uniform dispersion of droplets of at least one fluid in at least one other immiscible fluid in a mixer tank of a the system comprising:

a radial flow impeller rotatably driven by a drive shaft and having a plurality of radial flow inducing blades having blade tips terminating along a blade terminating circle radially outwardly of said drive shaft and having means for providing controlled shear stress on the fluids so as to create said dispersion of droplets, one face of said radial flow impeller disposed proximate a contoured fluid inlet port at the bottom of said mixer tank and concentric with said drive shaft; and a radial flow extension plate disposed adjacent another opposing face of said radial flow impeller and extending radially outwardly there along by a radial distance at least to said blade terminating circle.

2. The impeller system of claim 1, wherein said radial flow impeller, said plate, said drive shaft, and said mixer tank are constructed of molded fibrous and plastic materials.

3. The impeller system of claim 1, wherein said radial flow inducing blades are contoured at the bottom thereof toward said another opposing face.

4. The impeller according to claim 3 wherein said plate is a disk of a diameter which is at least 1.33 times larger than the diameter of said blade terminating circle.

5. The impeller system of claim 3, wherein said contoured radial flow inducing blades taper in a direction between said opposing faces and are narrowest near their tips.

6. The impeller system of claim 5, wherein said plate is fixedly attached to said other opposing face of said flow impeller.

7. The impeller system according to claim 3 wherein said another face defines edges of each said blades, said edges being arcuate.

8. The impeller system according to claim 7 wherein said edges are bulbous in cross-section.

9. The impeller system according to claim 8 wherein said blades taper and have reduced height between said opposing faces on a direction toward said tips.

10. The impeller system of claim 3, wherein said radial flow-inducing blades are curved blades having a radius of curvature in a range of from 0.2 to 0.4 of the diameter of said blade terminating circle, and said plate is a circular disk of a diameter which is at least 1.33 times larger than the diameter of said blade terminating circle.

11. The impeller system of claim 1, wherein said plate is fixedly attached to said other opposing face of said radial flow impeller.

12. The impeller system of claim 11, wherein said plate has a rim extending radially outward from said blade terminating under which is tilted with respect to said one face.

13. The impeller system of claim 1, wherein said plate is stationarily disposed adjacent said other opposing face of said radial flow impeller.

14. The system of claim 1 wherein said plate extends beyond said blade terminating circle, and forms a rim which is tilted away from the bottom of said tank.

15. The impeller system of claim 1 wherein said system is made efficient for selected head to produce selected flow of said fluid through said tank, said blades have a geometry selected from the group consisting of curvature, height, counter (and diameter and said inlet also has a cross section and contour to provide said efficient system for said selected head and flow.

16. An enhanced-flow and efficient impeller system for forming a uniform dispersion of droplets of at least one fluid in at least one other immiscible fluid in a mixer tank of the system comprising:

a radial flow impeller disposed in said tank and rotatably driven by a drive shaft and having a plurality of radial flow inducing blades having blade tips terminating along a blade terminating circle radially outwardly of said drive shaft and having means for providing controlled shear stress on the fluids so as to create said dispersion of droplets, one face of said radial flow impeller facing the bottom of said tank; and a radial flow extension plate disposed adjacent an opposing face of said radial flow impeller and extending radially outwardly there along by a radial distance at least to said blade terminating circle.

17. The impeller system of claim 16 wherein said plate extends radially beyond said terminating circle.

* * * * *